United States Patent [19]

Wiklund

[11] Patent Number: 5,009,013

[45] Date of Patent: Apr. 23, 1991

[54] DEVICE IN MACHINES FOR THE MARKING OF WORKPIECES

[76] Inventor: Henry W. Wiklund, Backvagen 1,S-820 10, Arbra, Sweden

[21] Appl. No.: 438,676

[22] Filed: Nov. 17, 1989

[30] Foreign Application Priority Data

Nov. 30, 1988 [SE] Sweden ..... 8804333

[51] Int. Cl.[5] ..... B43L 13/10

[52] U.S. Cl. ..... 33/25.1; 33/23.03; 409/97

[58] Field of Search ..... 33/23.03, 23.08, 23.11, 33/25.1, 25.3, 25.4, 24.1, 24.2; 409/86, 93, 97, 125, 130; 74/479

[56] References Cited

U.S. PATENT DOCUMENTS

| | | | |
|---|---|---|---|
| 2,481,658 | 9/1949 | Gruettner | 409/86 |
| 2,619,877 | 12/1952 | Wellenstein | 409/93 |
| 3,171,207 | 3/1965 | Wormser | 33/23.03 |
| 3,238,624 | 3/1966 | McCabe | 33/23.03 |
| 3,269,020 | 8/1966 | Anthony | 33/703 |
| 3,295,211 | 1/1967 | Nisenson | 33/23.11 |
| 3,496,795 | 2/1970 | Dinnendahl | 74/469 |
| 3,956,828 | 5/1976 | Kloweit | 33/23.11 |

*Primary Examiner*—William A. Cuchlinski, Jr.
*Assistant Examiner*—C. W. Fulton
*Attorney, Agent, or Firm*—Eric Y. Munson; Mark P. Stone

[57] ABSTRACT

The present invention provides a device to be used in machines which mark workpieces with characters or other symbols and have marking tools for applying the symbols to the workpiece, and elements for selecting the symbols and controlling the movements of the tools to obtain a desired shape and size of the symbols. In the device of the present invention, a lower frame part (1) receives a workpiece (7), and an upper frame part (2) is arranged on the lower frame part. The upper frame is capable of being raised and lowered and supporting the marking tool (43) and the symbol selection and control elements (36–42, 47–52, 69–74) of the machine. During a marking operation, the upper frame part (2) is arranged to rest on the workpiece (7) and clamp it against the lower frame part (1). A marking tool can work on the workpiece through an opening (44) in the upper frame part (2) of the device.

15 Claims, 4 Drawing Sheets

DEVICE IN MACHINES FOR THE MARKING OF WORKPIECES

The present invention relates to a device in machines intended for the marking of workpieces with characters or other symbols, said machines comprising a marking tool which applies the symbols to the workpiece, and devices for the selection of symbols and control of the movements of the tool in order to obtain a predetermined shape and size of the symbols.

THE STATE OF THE ART

The relevant machines can be divided into two main types. One is represented by machines fitted with an arm system which supports, firstly, a guide stylus intended for following grooves in templates forming patterns for the symbols to be applied and, secondly, a marking tool guided by the movements of the stylus. Depending on the design of the arm system, the copying of the symbols on the workpiece can be made at the ratio of 1:1 or with varying degrees of reduction or enlargement. To apply the marks to the workpiece, the operator of the machine moves, by hand, the guide stylus along the grooves in the templates, whereby the arm system transmits the pattern of movement, at a predetermined ratio, to the marking tool.

Another, and more novel, main type is represented by numerically controlled machines. These are fitted with a keyboard having keys for the selection of symbols, and a number of keys for the selection of the size of the symbols, for start and stop, etc., as well as a transmission mechanism controlled by means of impulses generated by operation of the keys and connected to the marking tool. This mechanism imparts movements to the marking tool which applies the wanted symbols to the workpiece.

The arm system of the pantograph type machines is usually fitted with adjustment devices for different reduction ratios of the symbols engraved, and also for adjustment of the position of the main shaft of the arm system in order to increase the range of the pantograph. If the machine is to be capable of marking workpieces of considerably varying thickness, which results in a corresponding variation of the vertical position of the surface to be marked, it must either be possible to adjust to a considerable degree the relative vertical positions of the tips of the engraving tool and the guide stylus, or to fit the machine with a support table for the workpieces which can be raised and lowered in relation to the machine frame. The machine must be provided with devices for the clamping of the workpieces.

The templates which are as a rule used for the engraving of the symbols consist of a set of individual types for each character or other symbol. The templates are selected from storage compartments and are inserted, one by one, into a copy slide provided with retaining grooves. In addition to this hand composition of the text to be engraved, which is in itself time-consuming, adjustments are required. The position of the text in the longitudinal direction of the copy slide must be determined according to scale as regards right and left margins as well as distances between separate groups of text on the same line. At the ends of each group, end stops must be secured. Furthermore, the position of the text in the transverse direction of the copy slide has to be determined according to scale, and if more than one slide is used in order to compose more than one line of text, the slides have to be spaced according to scale. It is also necessary to adjust and clamp the workpiece in the correct position in relation to the text having been composed and, if required, to adjust the clamping table vertically to conform with the thickness of the workpiece. When the marking operation is completed, all the templates, end stops and spacer pieces between words which have been used have to be removed and put back into their storage compartments.

The setting and adjusting operations described above for the pantograph type machines are time-consuming. With the numerically controlled machines, the marking operation can be carried out a good deal faster, but the range of application of these machines is limited, as the design solutions known today result in a complicated and costly construction which is to be discussed further below.

BRIEF DESCRIPTION OF THE INVENTION

On account of the relatively complicated setting and adusting operations which are required for known machines having a pantograph or a similar arm system, a skilled operator is needed in order to carry out a marking operation without an unreasonable consumption of time, and even in the case of a skilled operator the time required for preparation and completion work is considerable.

The present invention aims at achieving such simplifications as regards positioning and clamping of the workpiece and positioning of the template symbols in relation to same that the consumption of time is reduced considerably and that a marking operation can easily be carried out even by an unexperienced operator. Furthermore, the device in accordance with the invention can in a partictularly advantageous way be used in combination with a template device and retaining devices, etc., for same described below which are the object of a separate patent application filed by the inventor and which replace the known method of hand composing referred to above, said combination yielding further simplifications and saving of time.

The simplifications of the positioning and clamping of the workpiece referred to above and attained with the present invention can also be applied for building a numerically controlled marking machine, the design of which is, to a considerable extent, simplified and reduced in cost, as will be described here below.

The advantages in the form of time savings and reduction of cost have been attained with the device in accordance with the present invention as it is defined in the Claims.

BRIEF DESCRIPTION OF THE ATTACHED DRAWINGS

DETAILED DESCRIPTION OF A FIRST EMBODIMENT OF THE INVENTION

The device in accordance with the invention is; in FIGS. 1–4 of the drawings, exemplified as an engraving machine having a lower frame part 1 and an upper frame part 2. The frame parts are connected to one another by means of two pairs of arms 3*a*, 3*b* and 4*a*, 4*b* fastened on shafts 5 which are rotatably journalled in the frame parts, so that the upper frame part can be swung up from the lower part, the four fulcrums on each side of the frame parts forming a parallelogram always keeping the frame parts parallel to one another. At least one shaft 5 of each arm pair 3*a–b* and 4*a–b*, respectively, should extend from one side of its respective frame part to the opposite side and connect its arm pair rigidly, so that both arms of the pair are forced to perform the same swinging motion and deviations between the two sides are thereby prevented.

Figure 4:
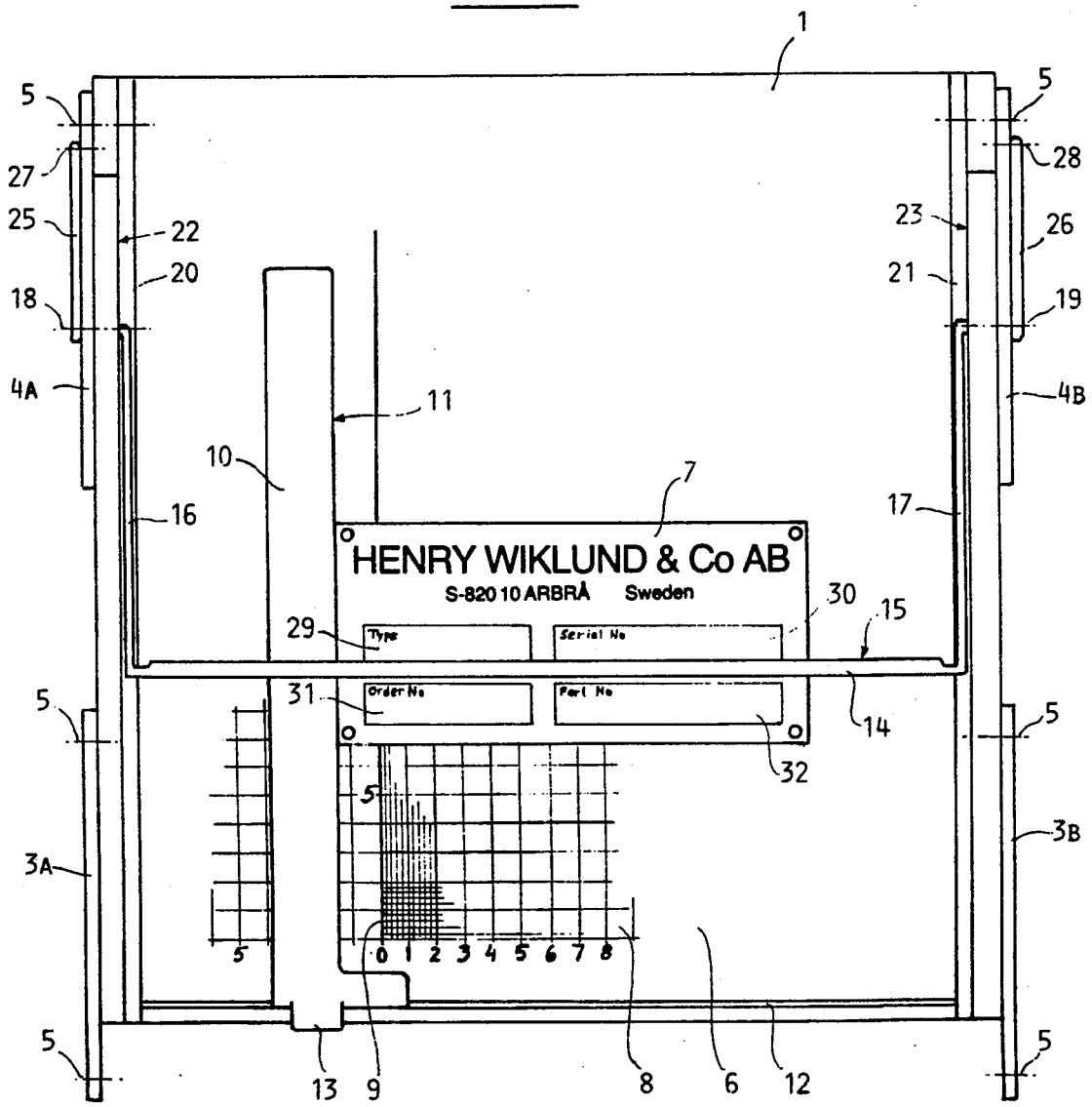

The lower frame part 1 has a receiving surface for workpieces. A workpiece 7 is shown positioned on this surface. In FIG. 4 a check pattern 8 forming a co-ordinate system is indicated on the receiving surface. As a guide for the positioning of workpieces, a more strongly indicated line 9 of this system defines the left-hand borderline for the working range of an engraving tool of the engraving machine.

On the receiving surface 6, a lateral stop 10 for workpieces is arranged slidable and lockable in position, for example in such a way that a turned-down edge 11 of the lateral stop can be moved along a groove 12 in the receiving surface and locked when pushed down into it and released when pulled up with the help of a protruding grip 13. The lateral stop 10 should have a lower height above the receiving surface 6 than the workpieces and can, for example, be made from 1 mm thick sheet steel or a plastic material.

A base line indicator 14 is arranged to extend, with an indicating edge 15, across the receiving surface 6, the lateral stop 10 and a positioned workpiece 7. The base line indicator has two legs 16, 17 which are perpendicular to the indicating edge 15. Swivel studs 18, 19 protrude from the ends of the legs, perpendicularly to these and parallel to the indicating edge. The studs and legs are inserted into grooves 20, 21 formed on opposite sides of the receiving surface 6, and the studs are rotatably journalled in side portions 22, 23 of the lower frame part 1 which are positioned higher than the grooves. The radius of the swinging movement of the indicating edge 15 around the studs 18, 19 is equal to the radius of the movement of a point on the upper frame part 2 when the latter is swung in relation to the lower frame part 1. The rotatable journalling of the studs 18, 19 is, in closer detail, made in such a way that the studs pass through slots 24 in the frame part 1 and are journalled at one end of eccentric rods 25, 26 which have their opposite ends journalled around fulcrums 27, 28 of the arms 4*a–b*. The fulcrums are located eccentrically in relation to the fulcrums 5 of the arms. When the arms 4*a–b* are swung, the eccentric rods will therefore impart to the studs a travelling motion in the slots 24.

The workpiece 7, exemplified as a name plate, has four marking surfaces 29–32, two in an upper row and two in a lower.

Figure 3:
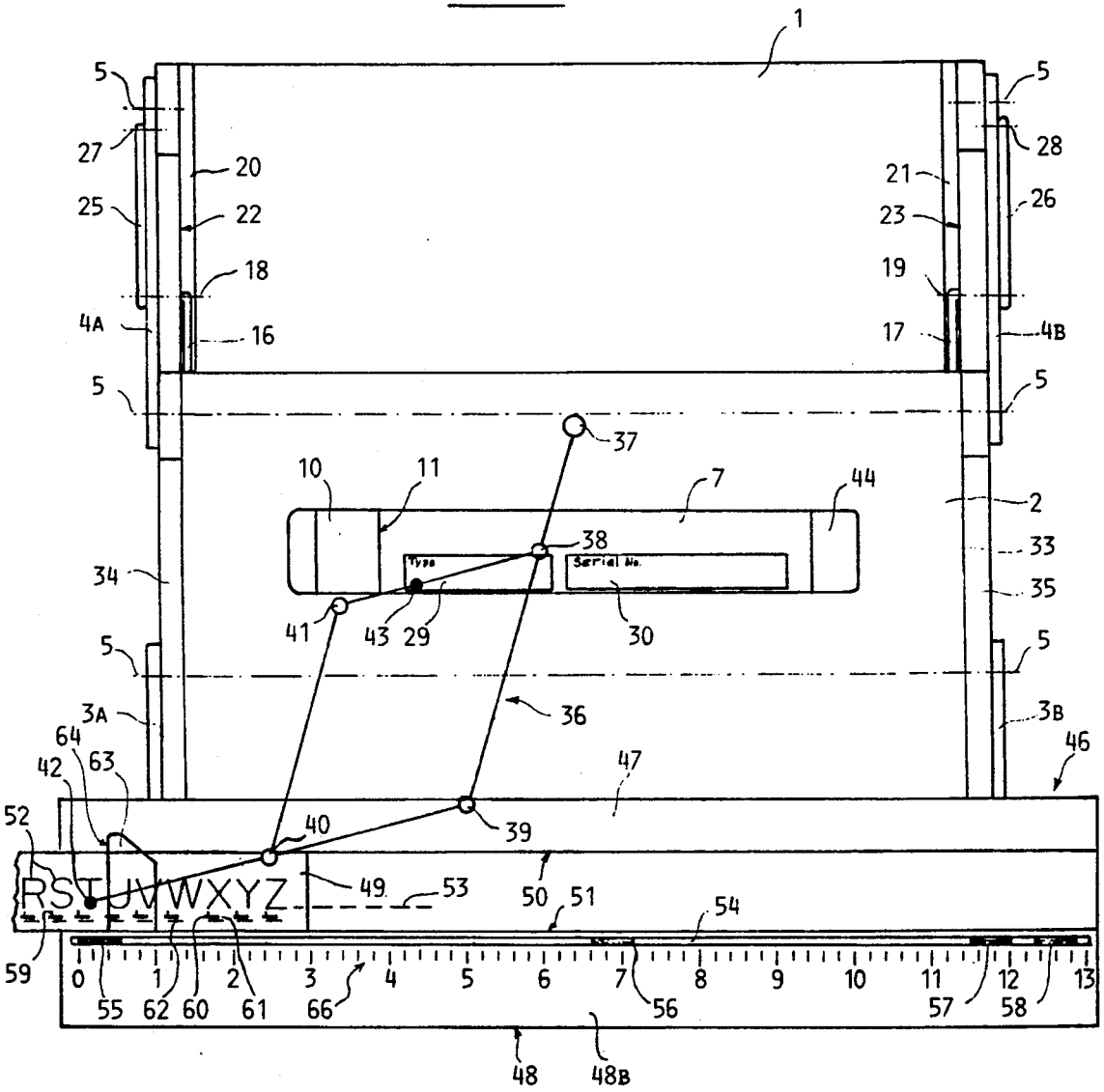

The upper frame part 2 is suitably made in the form of a plate 33 with elevated side portions 34, 35 for stiffening it. On the upper frame part, a pantograph 36 is fitted which in FIG. 3 is only schematically indicated. The pantograph is, in the usual way, rotatably journalled on a main shaft 37 which is in its normal position vertical but which can be turned into inclined positions around a horizontal shaft not shown. In the conventional way, the pantograph has an arm system which is articulated around axes 38–41 and which supports a guide stylus 42 and an engraving tool 43. Both of these can, in a way not shown in detail, have arrangements for vertical adjustment. In addition, the engraving tool can be provided with an adjustable depth regulator for adjustment of the engraving depth and, in the usual way, a drive unit which is not shown. On the whole, only the main outlines of the pantograph are shown, since in all essentials it is of the fully known type.

The engraving tool 43 of the pantograph is, in the working position, arranged to extend into an oblong opening 44 in the upper frame part 2 in order to contact a workpiece positioned on the lower frame part 1. Near one edge of the opening, a recess 45 is made on the underside of the upper frame part 2 to provide room for the base line indicator 14 when the upper frame part is lowered inro contact with the lower part or with a work piece positioned on same.

The upper frame part 2 has a widened portion 46 at one of its ends. On this portion two oblong strips 47, 48 are arranged between which an oblong template bar 49 is slidably arranged along guide edges 50, 51 of the strips. In a way not shown in detail, the strip 47 is suitably arranged to exert pressure, for example by spring action, against the template bar 49 to retain same in an assumed position, and to be pushed aside against the spring force to release the template bar when the latter is to be moved to a new position. On the template bar 49 template symbols 52 are provided, such as letters and figures for example, which are formed by grooves in the bar. The row of symbols is positioned in such a way that the base line 53, which coincides with the lower edges of the symbols (with the exception of the downstroke stems of certain lower-case letters, for example "y") irrespectively of the height of the symbols, always is at the same distance from the guide edge 51 when the template bar 49 is in contact with same. The distance between the guide edges 50 and 51 and the corresponding width of the template bar should be so chosen that, starting from the aforementioned base line, room is provided for the largest size of symbols which is intended to be used. Using the same standard width, it is then possible to manufacture template bars with varying height of the symbols (type size), all of which will fit between the guide edges 50 and 51. Changes between different symbol sizes are hereby quickly made, and the base lines which the guide stylus 42 and thereby also the engraving tool 43 follow will remain unchanged and no adjustments whatsoever will be required when a change is made from one template bar to another. The length of the template bar will of course, for the same number of symbols, vary in relation to the increase or reduction of the width of the symbols in proportion to their height. It can be suitable to provide the template bar with symbols on two sides in order to save length, whereby it will, for example, be easy to change between lower-case and capital letters by turning the bar.

The strips 47, 48 can be made in such a way that, in place of the template bar 49, it will also be possible to attach a copy slide for composing with individual templates in the conventional way, or to fit such templates direct between the strips.

A portion 48*b* connects with the strip 48 and is, on its top side, provided with a groove 54. In this groove, lateral position indicators 55–58 are slidably arranged which are intended to serve as indicators of selected left or right margins for the marking and also, in a way similar to that of tabulator stops in a typewriter, as indicators of selected starting positions for groups of symbols at different places between the margins.

The template bar 49 is, below its row of symbols, provided with lines 59 which indicate the distance from the beginning, i.e. the left end, of a symbol to the beginning of the next symbol. It is also provided with shorter lines 60, 61, which serves as guides for the selection of other distances between the symbols than the normal distances indicated by the longer lines 59. Below the symbols there are also horizontal lines 62 which extend a distance to the right from the lines 59 and serve as guides for determining the distance between words or other groups of symbols.

On the strip 48 a symbol position indicator 63 is arranged slidably in the longitudinal direction of the strip. The indicator is suitably made of a transparent material and is provided with an edge 64 intended to indicate the position of the left edge of a symbol 52, the grooves of which the guide stylus 42 is to follow. The symbol position indicator is slidable under light frictional resistance just above the template bar 49 without touching it. Therefore, movement of the template bar will not dislocate the symbol position indicator, or vice versa.

On two opposite sides of the lower frame part 1, stops 65 are provided which, when the lower frame part is swung up, by contacting the arm pair 3*a*, 3*b* determine the end position of the swinging movement and thereby also the indicating position of the base line indicator 14. For accurate adjustment of this position, the positions of the stops can be adjustable (not shown).

In connection with the groove 54 a scale 66 is provided which on an enlarged scale corresponds to the lateral distances which can be read off from the check pattern 8 on the lower frame part 1.

Operation and advantages of the described first embodiment of the device in accordance with the invention With the help of the device in accordance with the invention, an engraving operation can be carried out in the following way, whereby as an example is chosen the engraving of texts in the four marking surfaces 29–32 of a workpiece 7 in the form of a name plate.

Figure 2:
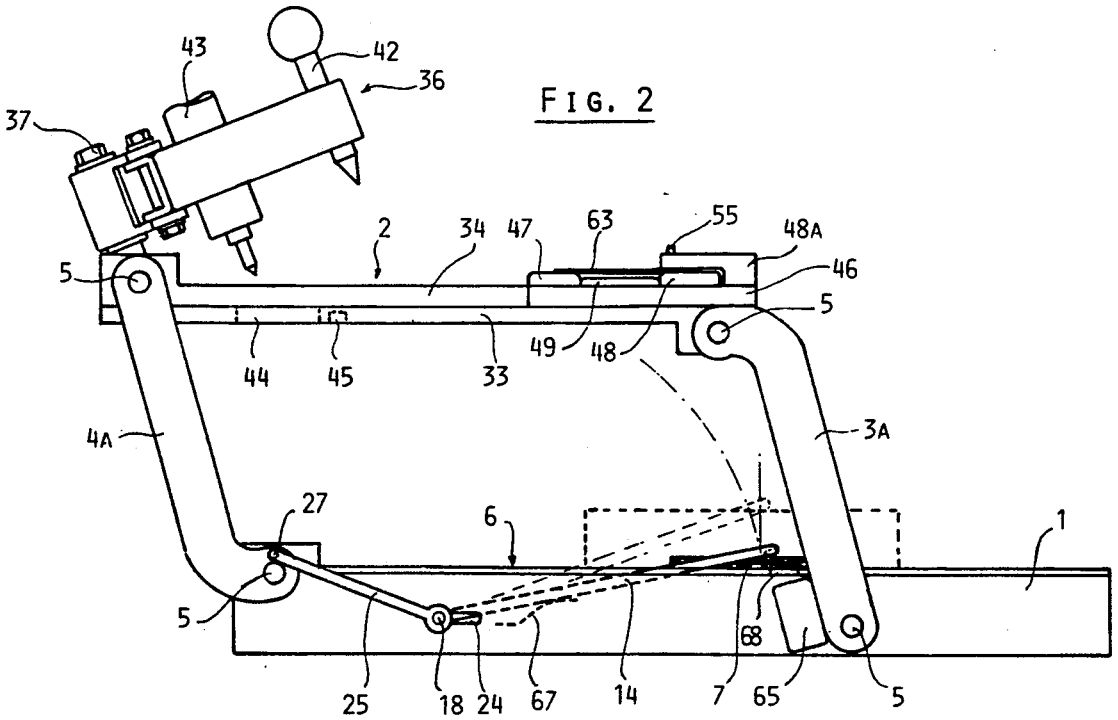

The upper frame part 2 is swung up from the lower part into the position shown in FIG. 2. The pantograph 36 is, by means of a spring or counterweight device, when folded into the inactive position shown in the figure suitably arranged to be automatically kept in a raised position above the frame part, so that neither the tip of the engraving tool 43, nor the guide stylus 42 will strike or scrape against any surfaces of same.

The name plate 7 is inserted below the base line indicator 14 and is placed in the desired lateral position and so that the lower edge of the desired row of text coincides with the indicating edge 15 of the base line indicator. The lateral position can be determined by making the name plate contact the adjustable lateral stop 10, which should be so positioned that the left margin of the text coincides with margin line 9 (designated by the measurement figure "0" of the check pattern 8), whereby the pantograph's whole range to the right can be utilized. On setting the left margin for the engraving tool's work on the name plate 8 at the figure zero, the operator knows that the starting position for the guide stylus 42 is at the corresponding scale line zero on the scale 66 of the upper frame part 2. He therefore marks this position by means of the lateral position indicator 55, if it is not already there—normally it can always be in this left margin position. On the check pattern 8 of the lower frame part 1 he can also see that the starting position for engraving in the two right-hand marking surfaces 30, 32 should be a couple of subdivision lines to the left of the FIG. 7 of the check pattern 8. He therefore moves the lateral position indicator 56 so that its left edge assumes the corresponding position on the scale 66. In this case it is not necessary to use the two lateral position indicators 57, 58, but these are suitably moved aside to the right end of the groove 54.

As is evident from the above, it is very simple to put the name plate in the correct position and read off and indicate the left margin as well as "tabulator positions" for groups of text to the right of same. When this is done, the upper frame part 2 is swung down into the position in accordance with FIG. 1, whereby the name plate 7 is clamped between the upper and the lower frame parts.

When the upper frame part 2 is swung up to an end position of the arms 3*a*, 3*b* against the stops 65 (FIG. 2), the eccentric rods 25, 26 move around the fulcrums of the arms 5, so that the base line indicator 14, which is journalled with its studs 18, 19 in the eccentric rods, is pulled into a position which, when its indicating edge 15 is pushed down against a workpiece, corresponds to the base line of the row of symbols which the engraving tool will engrave. When the upper frame part is swung down into its working position in accordance with FIG. 1, the eccentric rods 25, 26 will push away the base line indicator a few millimeters below the aforementioned lower edge of the row of symbols, so that it is not in the way of the engraving tool's tip. In this way it is possible to engrave characters which partly extend below the base line, for example the downstroke stems of lowercase letters, such as g, j, p, q and y. Furthermore, it is possible to make an exact indication of the position of the base line—if the indicator were not moved aside, it would be necessary to make the indication a short distance below the base line in order to avoid contact with the engraving tip, which would result in an inexact indication.

It may be suitable—as indicated at 67—to obtain, with the help of a weak leaf spring or the like, a raising of the base line indicator a short distance above the surface of a low workpiece 7, so that a light pressure of the hand is required to keep the indicator positioned against the workpiece for indication of the base line. It is then not required to lift the indicator in order to insert the workpiece below it, and furthermore the risk of the indicator's dislocating the workpiece is eliminated when, as described above, the indicator is moved aside from the base line during the lowering of the upper frame part 2. The lifting movement of the spring 67 can be short, so that clearance is obtained only in the case of low workpieces. It is only thin and light workpieces that risk being dislocated if the indicator glides along their surface, whereas such a sliding movement does not affect thicker and heavier workpieces.

During the last stage of the downward movement of the upper frame part 2, the portion of the base line indicator extending between its legs 16 and 17 enters a recess 45 in the underside of the frame part, so that the frame part can contact the workpiece without being impeded by the indicator.

When the upper frame part 2 has been swung down as described above, the workpiece is clamped in the right position and the engraving operation can be started. Let us assume that the word TEST is to be ingraved in the marking surface 29 of the name plate 7. The template bar 49 is moved in its groove between the strips 47, 48, until the left end of the letter T is right in front of the scale line zero of the scale 66, said position also being indicated by the lateral position indicator 55. The left edge of the symbol position indicator 63 is moved to the left edge of the next symbol on the template bar, i.e. U, whereby the indicator shows the position of the next letter to be engraved. The letter T is now engraved, whereupon the template bar is moved so that the left edge of E coincides with the left edge of the symbol position indicator, after which the indicator is moved to the next letter, F, and the letter E is engraved. After that, the letter S is positioned in relation to the indicator, etc. So, each time a letter has been moved to the correct position, and before it is engraved, the symbol position indicator is moved to the correct position for the next letter to be engraved.

The distances of these movements are suitably marked on the template bar by means of lines 59 below its letters or other symbols, which provides for a more distinct indication than if one only had to go by the edges of the differently shaped letters and symbols. The lines 59 denote the normal distance between the characters, whereas the shorter lines 60 and 61, respectively, on both sides of the lines 59 can be used for determining shorter or longer distances if it is desired to condense or space out the text.

It should be noted that the distance of movement of the symbol position indicator 63 from the front edge of a symbol to the next one varies with the lateral distance occupied by the respective symbol. A movement from the front edge of I to the neighbouring letter J is therefore considerably shorter than a movement from the front edge of M to N. In this way, all distances between symbols in the engraved text will be typographically correct, so that the text will look nice.

When, in the way described above, the word TEST has been engraved in the marking surface 29 and it is thereupon also desired to engrave a text in the surface 30, it is only required to position, by movement of the template bar 49, the first letter of this new text as indicated by the lateral position indicator 56, the position of which was adjusted in connection with the positioning of the workpiece, and to continue the work operation in the way described above.

If it is thereupon desired to engrave in the marking surface 31 of the lower row, the upper frame part 2 is swung up, so that the workpiece is released, the workpiece is pushed back a short distance along the edge of the lateral stop 10 until the indicating edge 15 of the base line indicator shows the suitable base line position in the surfaces 31, 32, and the frame part is swung down again. In the same way as in the foregoing, the operator will start with the first symbol at the left margin in the zero position indicated by the scale 66 and can, after having engraved the marking surface 31. proceed to the starting position at the lateral position indicator 56 to engrave the surface 32. It is thereafter only required to swing up the upper frame part and pick out the workpiece.

Figure 1:
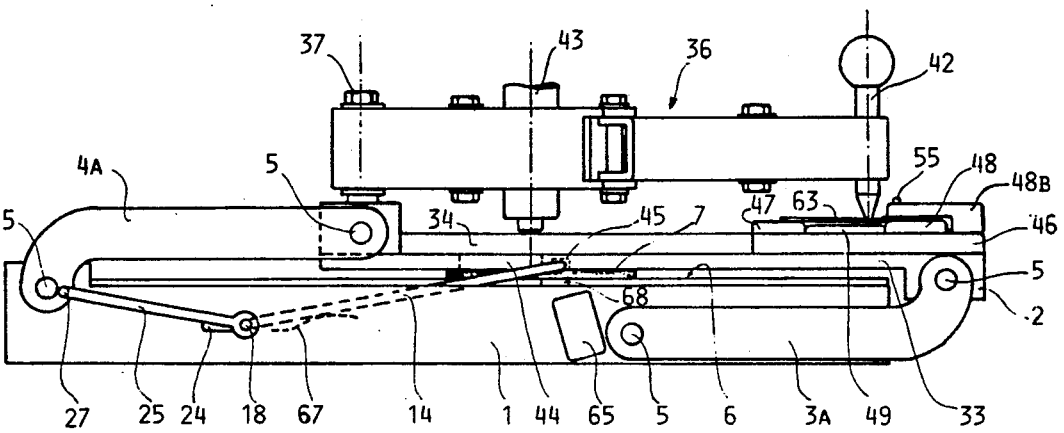
FIG. 1 is a side view of an embodiment of the device in accordance with the invention in the form of an engraving machine having a reducing pantograph and shown in the working position, FIG. 2 a side view of same with an upper frame part in a raised position, FIG. 3 a plan view of the device, and FIG. 4 likewise a view from above with the upper frame part removed.

If a workpiece has such a width that the range of the pantograph in the lateral direction is unsufficient, it is easy to move to a marking surface far to the right by swinging up the upper frame part and move the workpiece to the left. It should be noted that, apart from the legs 16, there are no other obstacles in the space between the frame parts 1 and 2 than the points of journalling of the arms 3*a–b*,4*a–b* at the ends of the frame parts. If the lateral stop 10 is removed and the workpiece is placed on a couple of shims above the base line indicator, it is possible to engrave signs or the like of any length, allowing their ends to protrude sideways outside the frame parts. The only disadvantage of this is that the exact position of the base line cannot be seen immediately but must be established by trial or measurement. For this, the check pattern 8 is helpful. The curved design of the arms 3*a–b*, 4*a–b* showed in FIGS. 1 and 2 is chosen in order to obtain the maximum amount of free space between the arm pairs.

An alternative to providing room for the base line indicator below the workpiece by means of shims is, as shown at 68, to make a groove in the lower frame part 1, into which the indicator can be lowered.

In the foregoing it has been described how, with the help of the lines 59 of the template bar 49, the normal spacing between letters or other symbols is determined. If, however, one does not only want to space two symbols within the same word or another group of symbols but wants to determine the distance between two words, one does not stop at the next line 59 but continues to move the symbol position indicator to the right end of the horizontal line 62 which is provided below each line 59.

In the device in accordance with the invention it is possible, and suitable, to manufacture the pantograph 36 without adjustable positions of the various points of articulation of the arm system and an unalterable ratio (for example 1:3) of the centre distance from the main shaft 37 to the engraving tool 43 and from the latter to the guide stylus 42. The position of the base line 53 along which the guide stylus works is also unalterable, and consequently the same applies to the corresponding line related to the operation of the engraving tool 43.

Instead of having to draw out the pantograph, as with the known engraving machines, in order to reach the one farthest away of several base lines arranged one after the other at increasing distances from the main shaft of the pantograph, the present invention features one single base line at the shortest possible and once and for all determined distance from the main shaft. In this way it is possible to utilize the range of the pantograph in the lateral directions to the maximum. For, the shorter a line perpendicularly from the base line to the main shaft of the pantograph—at a given length of the pantograph's arm system—the better the lateral range of the pantograph.

With the present invention it is simple and unexpensive to manufacture a stable and good pantograph, since it does neither require an extra length of its arms in order to reach a plurality of base lines, nor any adjustment devices with scales for different ratious of reduction.

The device in accordance with the present invention is particularly advantageous to use in combination with the slidable template bar 49 and the symbol position indicator 63 described in the foregoing. Instead of the bar 49 it is, however, as mentioned in the foregoing, also possible to fit a copy slide for individual templates between the strips 47, 48, or to insert such individual templates direct between the strips. This can be advantageous in the case of engraving operations which involve the repetition of the same text a number of times. In such a case, the slow hand composing is compensated for by the time gained at each repetition using an already composed and ready block of text. The engraving of more than one line of text presents no difficulty, since after each completed line one switches to a new block and, as described in the foregoing, moves the workpiece to a new position. If the text blocks are composed and ready in copy slides which fit between the strips 47, 48, it is easy to change the copy slides in the aforementioned way.

However, a disadvantage of using individual templates—in addition to the slow composing operation—is that several pieces are required of every individual character, since the same letter or other character may be repeated several times in a text. In addition, a number of end stops and spacer pieces of different kinds are required. A complete set of templates will as a rule consist of more than 150 pieces and is, therefore, expensive. Consequently, the cost is considerable if one wants to have several template sets of different type size in order to vary the size of the engraved characters without adjusting the ratio of reduction of the pantograph.

When using template bars 49, on the other hand, it is cheap to keep a varied assortment of type, since the cost of a template bar is much lower than that of a complete template set of the kind referred to above.

When the composing is made with individual templates, the usefulness of the devices described in the foregoing for quick adjustments of margins and other positions is the same as when using the template bar 49.

According to the present invention, the top side of a workpiece 7 is always on the same level in relation to the upper frame part 2 and the pantograph 36, regardless of the height of the workpiece—this because the top side of the workpiece is always in contact with the bottom side of the upper frame part, when the latter is swung down into working position. No devices are therefore required for vertical adjustment of engraving tool and/or guide stylus for engraving in workpieces of varying height, but only, in the usual way, a depth regulator for fine adjustment of the desired depth of the lines engraved in the workpiece. This, too, implies a simplification of the pantograph.

The upper frame part 2 is not raised and lowered along a straight vertical line but along an arc controlled by the arms 3*a–b*, 4*a–b*. Consequently, the position of the base line along which the engraving tool 43 engages a workpiece 7 varies depending on where along this curved path the engraving tool is when the upper frame part has come to rest on the top side of the workpiece, i.e. depending on the height of the workpiece. This change of the base line position in relation to the height of the workpiece is indicated by the base line indicator 14, as illustrated with dashed lines in FIG. 1. This because the base line indicator is so designed that its indicating edge 15 follows the same arced path as the swinging movement of the frame part 2 and that, when in the swung-up position of the frame part 2 the indicator is in contact with the workpiece, its legs 16, 17 have the same inclination as that of a line between the two fulcrums at opposite ends of each arm 3*a–b*, 4*a–b* when the upper frame part is in contact with said workpiece after having been swung down. Thus, regardless of the height of the workpiece, the correct indication for the positioning of the workpieces in order to have the marking on it correctly placed is always obtained.

As mentioned above it is, particularly in combination with template bars 49 of the type described which permit changes between different template sizes at low cost, possible to make the pantograph without an adjustment device for the variation of the ratio of reduction. On the other hand, there is nothing to prevent that the pantograph is provided with such a device in order that, if so desired, a totally stepless alteration of the size of the engraved characters can be made. In that case, the device should be made in such a way that, at the same time, the position of the main shaft on the frame part 2 and the position of the engraving tool in relation to the main shaft are altered so that the two alterations cancel each other out, i.e. so that the position of the base line followed by the engraving tool is not changed.

DETAILED DESCRIPTION OF A SECOND EMBODIMENT OF THE INVENTION

Figure 5:
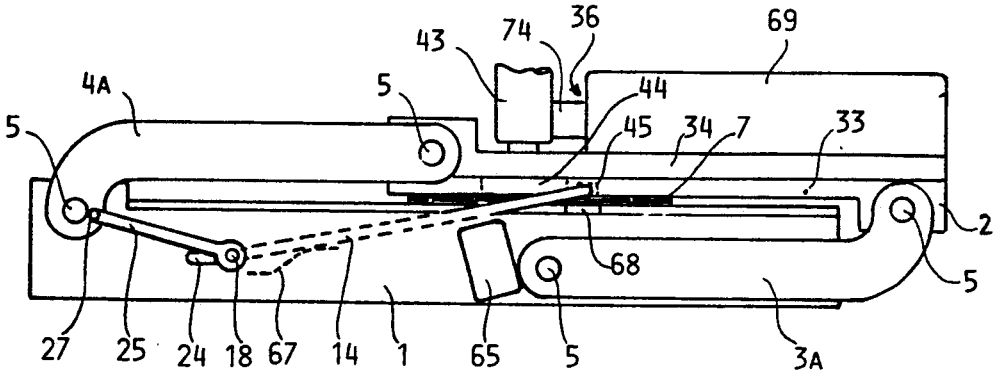
FIGS. 5 and 6 are side views and plan views, respectively, of an embodiment of the device in accordance with the invention shown as a numerically controlled engraving machine.
Figure 6:
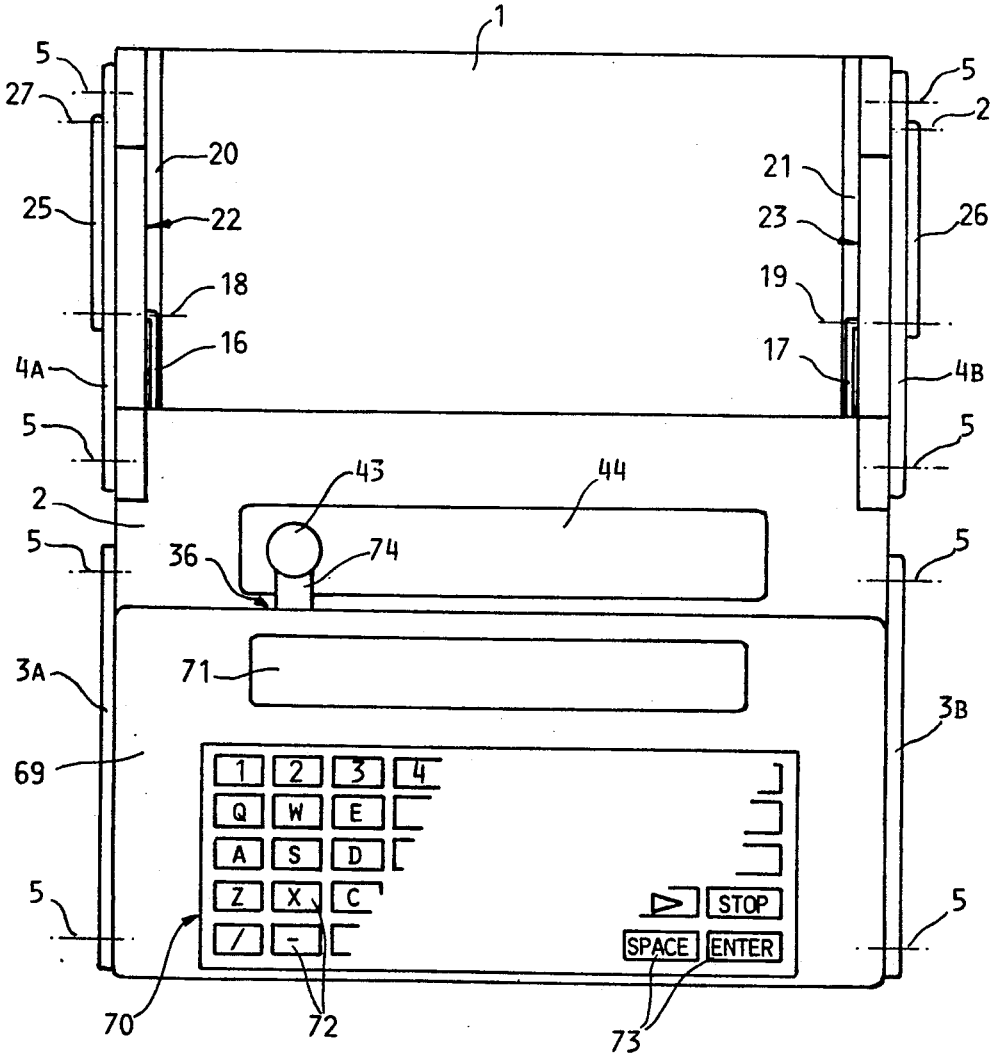

This embodiment of the invention is in the FIGS. 5 and 6 of the drawings exemplified as a numerically controlled engraving machine. The embodiment shown is in principle identical with the first embodiment described in the foregoing as regards the frame of the machine with a lower frame part 1, an upper frame part 2, the arms 3*a–b*, 4*a–b* with their shafts 5, and the base line indicator 14 with the relevant devices, as well as the devices for positioning and orienting the workpiece 7 and clamping it between the frame parts. All parts which are common to the two embodiments are in the drawings denoted by the same numerals, for which reason the description of the first embodiment should be fully sufficient for the understanding of the second embodiment as regards their common features.

As in the case of the first embodiment, the machine is provided with an engraving tool 43, the drive unit of which (for example for rotation of a graver fitted in the tool) is not shown. The difference is that in this case the engraving tool is not controlled by means of an arm system of the pantograph type via grooved templates and a guide stylus, but by means of a numerical control unit of the micro-computer type or similar. In other respects, the tool operates in exactly the same way as described earlier, through the opening 44 in the upper frame part 2.

The control unit is in the FIGS. 5 and 6 denoted by the reference numeral 69. It is fitted with a keyboard 70 and a display window 71. On the keyboard are keys 72 for the selection of characters and a number of control keys 73. From the control unit, through an oblong slot in one of its sides, a movable scriber arm 74 protrudes which supports a marking tool 43. The scriber arm forms part of a movement transmission mechanism inside the controlled unit 69, which mechanism is not shown but which is referred to in FIG. 6 by the reference numeral 36, which is the same as the one used in the foregoing to generally denote the pantograph of the first embodiment of the invention.

Operation and advantages of the described second embodiment of the device in accordance with the invention Raising and lowering of the upper frame part 2 as well as positioning and clamping of a workpiece 7 are made in the way described for the first embodiment. The determining of the position of the workpiece is consequently made exactly as shown in FIG. 4, with the help of a base line indicator 14 and a lateral stop 10.

The selection of marking characters, size of the characters, start and stop positions for text blocks, input into the memory of the control unit and output—i.e. the carrying out of the marking operation—are made in the known way with the help of the various keys of the keyboard.

The advantages which are gained with the device in accordance with the invention are as follows:

Positioning and clamping of the workpiece are made very quickly and simply. However, what is above all gained through the possibility of quick and simple movement of the workpiece, on the one hand perpendicularly to the base lines of the text in order to change to a new line, and on the other hand in the longitudinal direction in order to increase the length of the text lines, is a substantially simplified and cheapened marking machine of the numerically controlled type which can meet the demands of users in fields where the known computerized marking machines are not profitable, as the cost of procurement is too high. A fact further contributing to this simplification and cheapening of the machine is that in the device in accordance with the invention the marking tool 43 will—as described in the foregoing—always be in the correct position relatively to the workpiece 7 regardless of its height. The upper frame part 2 which supports the marking tool rests on the workpiece and will therefore always adapt its vertical position to the height, i.e. thickness, of same.

The designs of the known engraving machines of the numerically controlled type are based on the method of clamping the workpiece on a chuck table in the conventional way and, in the normal case, retaining it in the same position during the whole engraving operation. Therefore, the movement transmission mechanism controlling the engraving tool must be able to cover a large area, and furthermore vertical adjustment devices are required for varying thickness of the workpieces. In this way, the mechanism cannot, in the simple way suggested in the present invention, be provided with a short, overhung scriber arm 74 but requires sturdier and more complicated devices in order to steadily hold and guide the engraving tool over the entire working area. In addition, the machines are as a rule provided with sophisticated programming and control functions which permit the engraving of different patterns, such as trade marks and the like, which also contributes to making them complicated and expensive to buy.

The idea of the embodiment in accordance with FIGS. 5 and 6 is to use a simple type of numerical control unit 69 which is mainly intended to be capable of marking workpieces such as for example name plates for machines with short texts containing letters, numerals and other characters such as hyphens, etc. The control unit can be designed in mainly the same way as the numerically controlled scribers which are already in the market, the main outlines of which conform in all substantial parts with FIGS. 5 and 6. These scribers are chiefly intended for applying text to drawings and can be fitted on the draughting machines used in drawing offices. In these cases, a drawing ink pen is fitted on the scriber arm 74. Usually, the scriber arm covers only one or two lines of writing. The only real change required to use, in principle, the same solution to the design problem in the present invention is that the scriber arm 74 and the connected movement transmission mechanism 36 inside the control unit must be made more robust than in the existing scribers in order to steadily guide an engraving tool. Since, in the device in accordance with the present invention, the workpiece 7 is simple to move and orientate with the help of the base line indicator 14 for changing to a new line of text, the scriber arm 74 may very well be made for movement along one and the same line without provisions for movement to a new line. This simplifies both the electronic control programme and the mechanical part of the movement transmission mechanism. Steady control of the marking tool 43 is easily obtained, as the scriber arm 74 can be made with a short overhung length.

Closer definition of the scope of the invention

The invention is applicable within the entire field defined in the pre-characterizing part of claim 1. For the sake of simplicity, in connection with the first embodiment it has mainly been referred to an arm system of the reducing pantograph type and, furthermore, the specification mainly refers to an engraving tool and engraving, which has been done only for purposes of exemplification. The invention is thus not limited to these embodiments, but the arm system can be of another type, for example for the reproduction of characters on the scale 1:1 or with enlargement, and the marking tool can be intended for other forms of application of marks than engraving, for example tracing or the application of ink. In other respects, too, variations are possible within the scope of the invention.

I claim:

1. A device for machines adapted for marking a workpiece with characters or other symbols during a marking operation, said machines being of the type comprising a marking tool which applies the symbols to the workpiece and means for the selection of symbols and control of the movements of the tool in order to obtain a predetermined shape and size of the symbols, said device characterized by a lower frame part (1) for receiving said workpiece (7), an upper frame part (2) arranged on said lower frame part and means (**3*a*, 3*b*, 4*a*, 4*b*) for connecting said frame parts for raising and lowering said upper frame part relative to said lower frame part (1), said upper frame part supporting the marking tool (43) and the symbol selection and control devices (36–42, 47–52, 69–74) and being arranged, during the marking operation, to rest on the workpiece (7) and clamp said workpiece (7) against the lower frame part (1), said upper frame part (2) having an opening (44) through which the marking tool works on the workpiece (7**).

2. A device in accordance with claim 1, characterized in that a receiving surface (6) of the lower frame part (1) is provided with markings arranged to form a co-ordinate system (8) as a guide for the positioning of workpieces (7) on said surface.

3. A device in accordance with claim 2, characterized in that, on the upper frame part (2), a measuring scale (66) is provided which indicates positions in a lateral direction parallel to the longitudinal direction of a line of characters produced during a marking operation which on an enlarged scale correspond to such position indications which can be read off from the co-ordinate system (8) of the lower frame part (1).

4. A device in accordance with claim 1, characterized in that the lower frame part (1) is provided with at least one stop (11) which is capable of being moved laterally in order to determine the positioning of workpiece (7)

by contacting said workpiece, said stop having a lower height than the workpiece.

5. A device in accordance with claim 1, characterized in that, on the upper frame part 2, movable lateral position indicators (55–58) are provided in order to indicate margins, or starting points between said margins, for groups of text or other symbols with which a workpiece is to be marked.

6. A device according to claim 1 characterized in that a baseline indicator (14) is movable mounted relative to the lower frame part (1) for indicating, when said upper frame part (2) is raised relative to said lower frame part, the position, on a workpiece (7) received on said lower frame part, of a baseline along which the marking tool (43) will work on said workpiece when said upper frame part is lowered onto said lower frame part for resting on said workpiece during said marking operation.

7. A device in accordance with claim 6, characterized in that a receiving surface (6) of the lower frame part (1) is provided with markings arranged to form a co-ordinate system (8) as a guide for the positioning of workpieces (7) on said surface.

8. A device in accordance with claim 7, characterized in that, on the upper frame part (2), a measuring scale (66) is provided which indicates positions in a lateral direction parallel to the longitudinal direction of a line of characters produced during a marking operation which on an enlarged scale correspond to such position indications which can be read off from the co-ordinate system (8) of the lower frame part (1).

9. A device in accordance with claim 6, characterized in that the lower frame part (1) is provided with at least one stop (11) which is capable of being moved laterally in order to determine the positioning of workpiece (7) by contacting said workpiece, said stop having a lower height than the workpiece.

10. A device in accordance with claim 6, characterized in that, on the upper frame part 2, movable lateral position indicators (55–58) are provided in order to indicate margins, or starting points between said margins, for groups of text or other symbols with which a workpiece is to be marked.

11. A device in accordance with claim 6, characterized in that the baseline indicator (14) is arranged to be moved laterally across the workpiece received on said lower frame part a predetermined distance from the position indicating the line of work of the marking tool (43) when the upper frame part (2) is lowered into a working position against the workpiece (7) supported on the lower frame part (2), wherein said baseline indicator (14) does not obstruct said marking tool (43) during said marking operation.

12. A device in accordance with claim 11, characterized in that a receiving surface (6) of the lower frame part (1) is provided with markings arranged to form a co-ordinate system (8) as a guide for the positioning of workpieces (7) on said surface.

13. A device in accordance with claim 12, characterized in that, on the upper frame part (2), a measuring scale (66) is provided which indicates positions in a lateral direction parallel to the longitudinal direction of a line of characters produced during a marking operation which on an enlarged scale correspond to such position indications which can be read off from the co-ordinate system (8) of the lower frame part (1).

14. A device in accordance with claim 1, characterized in that the lower frame part (1) is provided with at least one stop (11) which is capable of being moved laterally in order to determine the positioning of workpiece (7) by contacting said workpiece, said stop having a lower height than the workpiece.

15. A device in accordance with claim 11, characterized in that, on the upper frame part 2, movable lateral position indicators (55–58) are provided in order to indicate margins, or starting points between said margins, for groups of text or other symbols with which a workpiece is to be marked.

* * * * *